United States Patent [19]

Farmer

[11] Patent Number: 4,790,092

[45] Date of Patent: Dec. 13, 1988

[54] DISPLAY SIGN

[76] Inventor: Kenneth R. Farmer, 891 Glenbrook Dr., NW., Atlanta, Ga. 30318

[21] Appl. No.: 896,321

[22] Filed: Aug. 18, 1986

Related U.S. Application Data

[63] Continuation-in-part of Ser. No. 819,812, Jan. 17, 1986, abandoned.

[51] Int. Cl.[4] ..... G09F 15/00

[52] U.S. Cl. ..... 40/607; 40/606; 40/611; 40/617; 40/610

[58] Field of Search ..... 40/607, 610, 617, 152.1, 40/611, 612; 211/45, 113; 248/489

[56] References Cited

U.S. PATENT DOCUMENTS

| | | | |
|---|---|---|---|
| 1,603,311 | 10/1926 | Brett et al. | 40/607 |
| 1,758,292 | 5/1930 | Meyer et al. | 40/617 |
| 1,766,518 | 6/1930 | Janin | 40/607 |
| 1,866,554 | 7/1932 | Fairbanks | 40/617 |
| 1,908,360 | 5/1933 | Hunt | 40/607 |
| 2,681,030 | 6/1954 | Hoge | 40/610 |
| 2,899,763 | 8/1959 | Jones, Sr. | 40/606 |
| 3,154,870 | 11/1964 | Hopp et al. | 40/617 |
| 3,529,798 | 9/1970 | Williams et al. | 40/607 |
| 4,217,713 | 8/1980 | Greenberger | 40/611 |
| 4,327,514 | 5/1982 | Bourque | 40/617 |
| 4,375,134 | 3/1983 | Sheetz | 40/610 |
| 4,583,482 | 4/1986 | Smith | 40/610 |

FOREIGN PATENT DOCUMENTS

| | | | |
|---|---|---|---|
| 2433443 | 1/1976 | Fed. Rep. of Germany | 40/617 |
| 482577 | 3/1917 | France | 40/617 |
| 515147 | 3/1921 | France | 40/10 R |
| 628437 | 10/1927 | France | 40/607 |
| 552926 | 4/1943 | United Kingdom | 40/10 R |
| 729362 | 5/1955 | United Kingdom | 350/117 |

*Primary Examiner*—Gene Mancene
*Assistant Examiner*—J. Hakomaki
*Attorney, Agent, or Firm*—Wigman & Cohen

[57] ABSTRACT

A display sign has a panel supported on a horizontal arm which is cantilevered on a vertical post. A slot is formed in the horizontal arm and the panel is supported in the slot. The horizontal arm includes a pair of parallelly extending, spaced-apart channel members and a pair of spacers, one of which is inserted at each end of the channel members. The spacers span the channel members and join them together. The slot in the horizontal arm is formed by a gap between the spaced apart channel members. One type of panel which has an upper portion with a width greater than the width of the lower portion is supported in the slot by the spacers. Another type of panel having a lower portion greater in width than in its upper portion and a neck portion with a pair of cutouts is supported in the slot by pivotably mounted plates which engage in the cutouts. In one embodiment, the horizontal arm is pivotally mounted on the vertical post so that it may be pivoted upwardly and over the post into substantially parallel, side-by-side relation with the post for storage or transportation. In another embodiment, the horizontal arm is removably supported on the vertical post by brackets. A foot fixed to the bottom of the vertical post receives the sharpened bottom end of the post and has a pointed tooth disposed thereon. The bottom end of the post and tooth are implanted in the ground to support the display sign in an upper position.

17 Claims, 5 Drawing Sheets

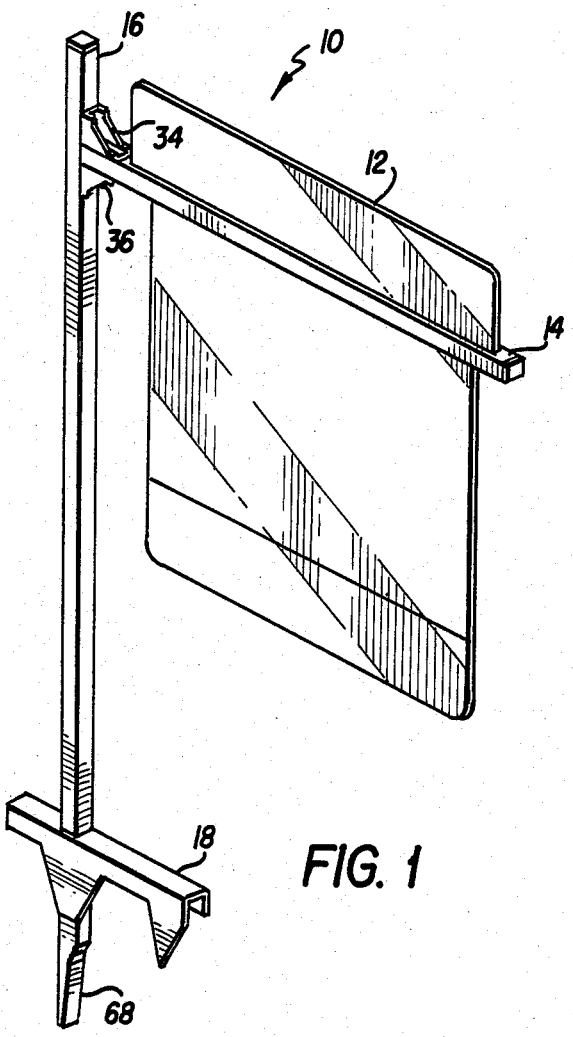
FIG. 1
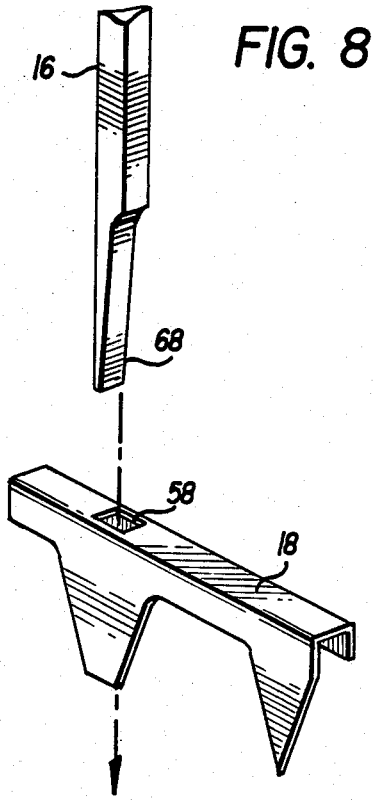
FIG. 8
FIG. 9
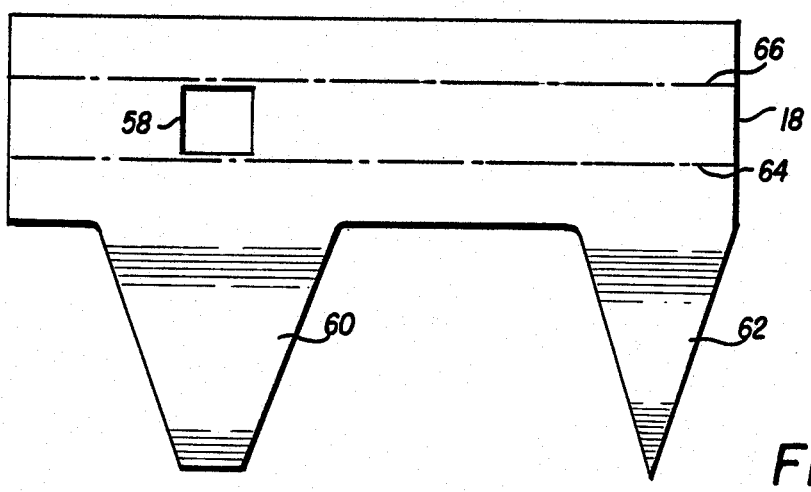
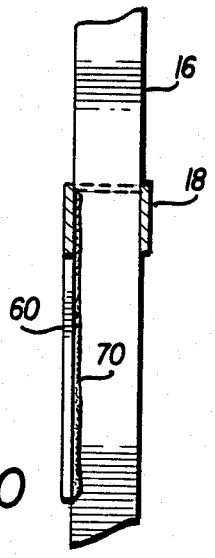
FIG. 10

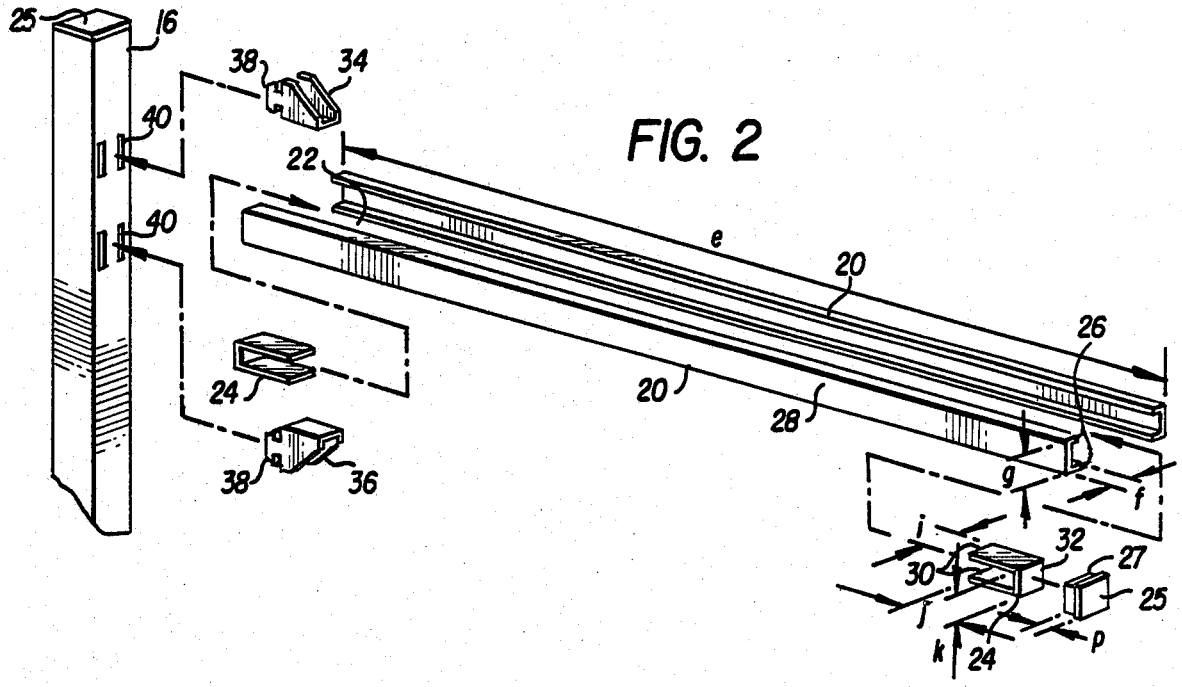
FIG. 2
FIG. 7
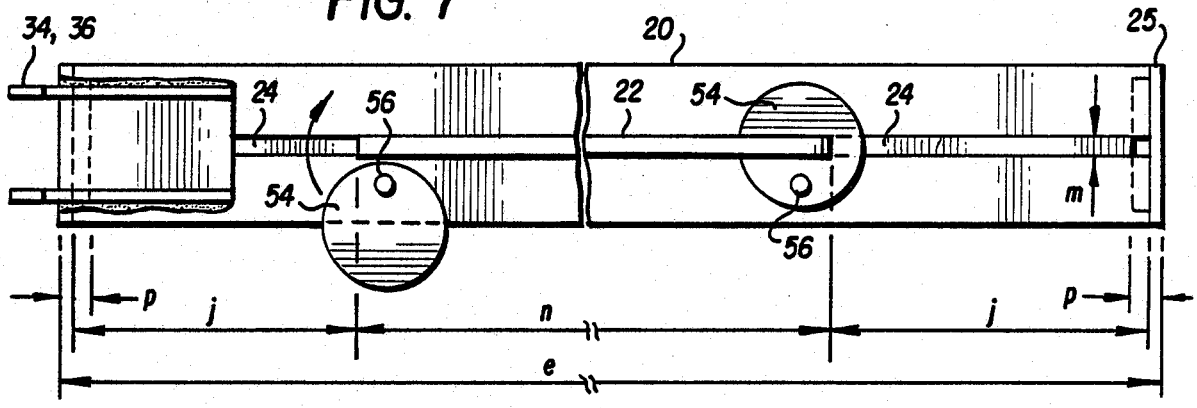
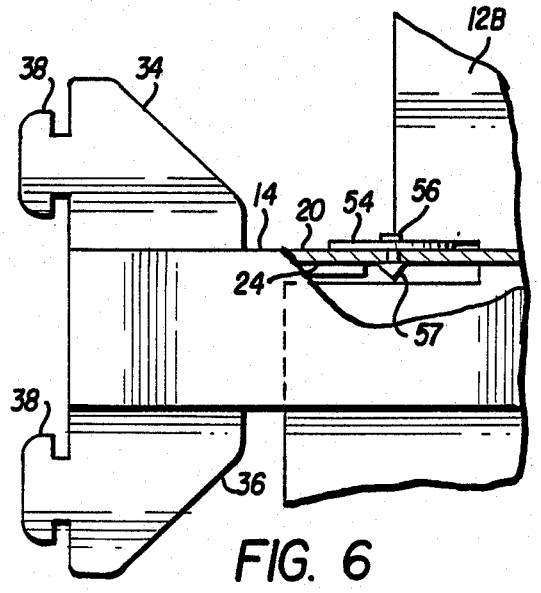
FIG. 6
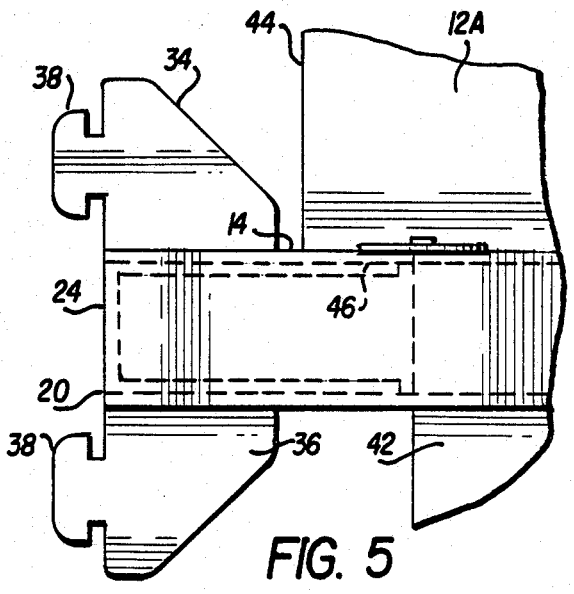
FIG. 5

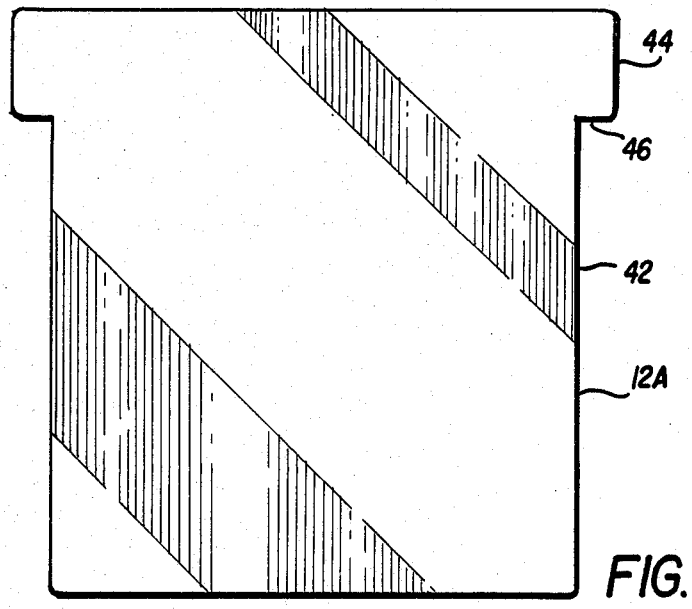
FIG. 3
FIG. 4
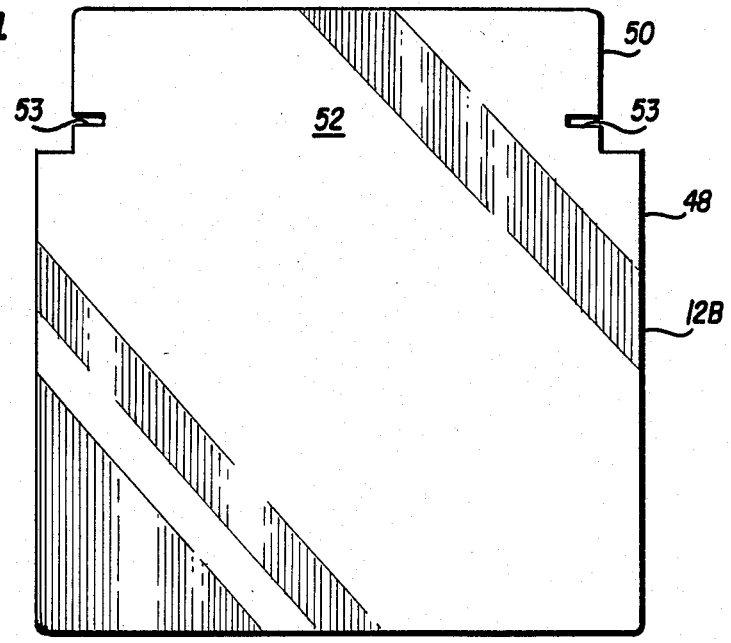

DISPLAY SIGN

This is a continuation-in-part of co-pending application Ser. No. 819,812 filed on Jan. 17, 1986 now abandoned.

BACKGROUND OF THE INVENTION

The present invention relates to a display sign and more particularly to a display sign in which a display panel is supported in cantilever fashion on a vertical post.

One familiar type of display sign uses a vertical post, a horizontal arm cantilevered on the vertical post and a display panel suspended from the horizontal arm. The display panel is generally suspended from the horizontal arm by means of hooks and rings to allow the sign panel to swing freely beneath the horizontal arm. This type of sign has a quaint appearance and is very popular in advertising displays where it is desirable to make a favorable impression.

One major use of this type of sign is in the real estate industry. However, a problem has developed in the use of the signs in that industry. The type of sign used in the real estate industry has slowly developed so that it is now costly to install and inconvenient for the real estate agent to use. The signs in current use are typically installed by a professional sign company which charges a fee for each installation. In addition, there is a delay between the time when the real estate agent obtains a listing and the installation of the sign. This is extremely undesirable since it is important to the sales agent that the sign be placed as soon as possible on the listed property.

Another problem with the signs in current use is that attachments to the sign, such as rider with the agent's name, are affixed by the use of "s" hooks which are suspended from the existing panel. The use of "s" hooks requires that agents maintain a supply of the hooks and must take care not to forget the hooks when making an installation. Furthermore, the use of "s" hooks prevents a inviting target for theft and vandalism.

Additionally, the signs in current use are expensive, bulky, and difficult to transport in an automobile. Moreover, high winds often cause disengagement of the signs and riders from the arms of the signpost.

SUMMARY AND OBJECTS OF THE INVENTION

In view of the foregoing drawbacks of the prior art display signs as well as other disadvantages not specifically mentioned above, it should be apparent that there still exists a need in the art for a display sign which is attractive, while at the same time being less expensive, easily transportable, readily installed by a real estate agent, durable, and self-contained. It is, therefore, a primary object of this invention to fulfill this need by providing a display sign in which a panel is supported by a cantilevered arm without the use of additional hardware such as loops or rings.

More particularly, it is an object of this invention to provide a display sign which is readily installed by the layman without resort to a professional installer.

It is another object of this invention to provide a display sign in which the panels may be readily interchanged and riders may be attached without the use of additional hardware.

Yet another object of this invention is to provide a display sign which is compact, lightweight, readily collapsed and/or disassembled, and thus easily transportable in the trunk of a car.

Still another object of this invention is to provide a display sign which meets all of the aforementioned objects and yet which is attractive and presents the favorable impression of the more expensive cantilevered sign arrangement.

Briefly described, the aforementioned objects are accomplished according to the invention by providing a panel having an advertising display, a vertical post, and a horizontal arm supported in cantilever fashion on the vertical post.

In one embodiment, the horizontal arm is pivotally mounted on the vertical post so that the arm can be pivoted upwardly over the top of the post and into substantially parallel, side-by-side relation with the post for easy storage and transportation. In another embodiment, the horizontal arm is detachably mounted on the vertical post by means of brackets. A slot is formed in the horizontal arm and the panel is slipped into the slot. Means are provided for supporting the panel in the slot.

The horizontal arm is preferably made from a pair of longitudinally extending U-shaped channel members which are disposed parallel to each other and spanned by a pair of spacers, one spacer disposed at each end of the channel cantilevered beam members. This construction gives the appearance of a more expensive wooden cantilevered beam. The channel members are spaced apart from one another by a gap which forms the slot which receives the panel. The spacers extend inwardly from the ends of the channel members toward the center and close the end portions of the slot. One type of panel which has a lower portion having a smaller width than an upper portion, thereby forming a shoulder on the panel, is supported on the horizontal arm by sliding the lower portion into the slot so that the shoulders bear upon and are supported by the spacers of the arm. An alternate panel design has an upper portion with a smaller width than the lower portion and a neck disposed between the upper and lower portions and a pair of inwardly extending cutouts in the neck. This panel is supported on the horizontal arm by means of support plates which are pivotally mounted on the arm. To install the panel, the support plates are pivoted to uncover the slot in the arm, the upper portion of the panel is inserted from the bottom of the slot, and the support plates are pivoted into the cutouts in a locking position to support the panel at the neck.

The horizontal arm is mounted on the vertical post pivotally or by means of a bracket. The bracket is fixed to the horizontal arm and has a plurality of laterally extending tongues which mate with a plurality of grooves formed in the vertical post.

A foot is fixed to the bottom of the vertical post. The bottom of the vertical post is sharpened and extends through an aperture in the foot. The foot is provided with a pointed tooth member which, together with the sharpened bottom end of the vertical post, is driven into the ground to support the sign.

With the foregoing and other objects, advantages and features of the invention that will become hereinafter apparent, the nature of the invention may be more clearly understood by reference to the following detailed description of the invention, the appended claims, and to the several views illustrated in the attached drawings.

BRIEF DESCRIPTION OF THE DRAWINGS

FIG. 1 is a perspective view of one embodiment of the display sign according to the present invention;

FIG. 2 is an exploded perspective view of the upper portion of the display sign according to the present invention;

FIG. 3 is a front elevational view of one embodiment of panel of the display sign of the present invention;

FIG. 4 is a front elevational view of an alternate embodiment of panel of the display sign of the present invention;

FIG. 5 is a partial sectional view illustrating the support of the panel of FIG. 3 on the horizontal arm of the display sign of the present invention;

FIG. 6 is a partial sectional view illustrating the support of the panel of FIG. 4 on the horizontal arm of the display sign of the present invention;

FIG. 7 is a top view of the arm of the display sign according to the present invention;

FIG. 8 is an exploded perspective view of the bottom portion of the display sign according to the present invention;

FIG. 9 is a front elevational view of the foot of the display sign during one stage of the manufacture of the foot in accordance with the present invention;

FIG. 10 is a partial sectional view of a portion of the bottom of the vertical post of the display sign according to the present invention.

DETAILED DESCRIPTION OF THE PREFERRED EMBODIMENTS

Figure 11:
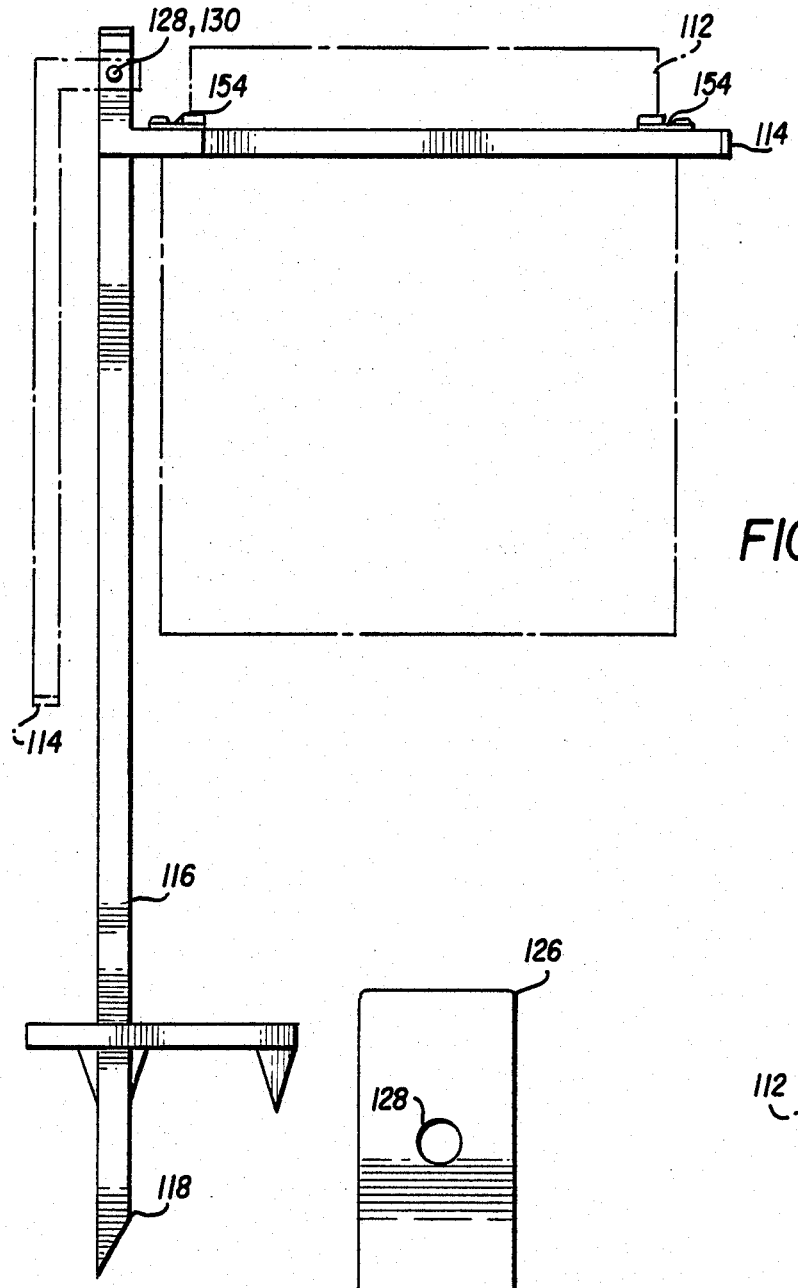
FIG. 11 is a front elevational view of an alternative embodiment of the display sign of the present invention in which the horizontal arm is pivotally mounted on the vertical post.

Referring now in detail to the drawings, there is illustrated in FIG. 1 a display sign constructed in accordance with one embodiment of the invention and designated generally by reference numeral 10. Display sign 10 comprises a panel 12, a horizontal arm 14, a vertical post 16, and a foot 18.

Panel 12 is adapted to receive a display such as an advertising display and is supported by horizontal arm 14. Horizontal arm 14 is supported in cantilever fashion on vertical post 16.

Referring now to FIGS. 2 and 7, the construction of horizontal arm 14 is shown in greater detail. Horizontal arm 14 is formed from a pair of longitudinally extending U-shaped channel members 20. Channel members 20 are disposed parallel to one another with the open faces of their cross-section facing one another and spaced apart from each other to form a gap therebetween which forms a slot 22 in horizontal arm 14. A pair of spacers 24 are positioned between channel members 20. One spacer 24 is inserted at each end of the spaced-apart channel members 20. Spacer members 24 span channel members 20 and join the channel members together. For example, each spacer member 24 may be joined to both channel members 20 by spot or bead welding. A plastic end cap 25 may be inserted in one or both of the free ends of horizontal arm 14 as well as in the upper end of vertical post 16.

In a preferred embodiment, channel members 20 and spacers 24 are so dimensioned and positioned as to facilitate construction of horizontal arm 14. Thus, the U-shaped cross-section of channel members 20 forms channel fingers 26 and channel backs 28. Similarly, the U-shaped cross-section of spacers 24 forms spacer fingers 30 and spacer back 32. Channel fingers 26 extend longitudinally over a dimension e and extend inwardly over a dimension f. Channel back 28 has a height of dimension g. Similarly, spacer fingers 30 extend over a dimension i and extend outwardly over a dimension j. Spacer back 32 has a height of dimension k. Cap 25 has an insert portion 27 having a dimension p, and a cap is inserted in either end of horizontal arm 14. Specifically, the height k of spacer back 32 is slightly less than the height g of channel back 28 minus twice the thickness of channel fingers 26, so that spacer 24 fits snugly between channel fingers 26 and lies within the channels of channel members 20 with its back 32 recessed a dimension p from the free ends of the channel members 20 to accommodate cap 25. The width i of spacer fingers 30 is greater than the inward extent f of channel fingers 26. The difference between dimension i and twice dimension f is equal to the width m of slot 22 as shown in FIG. 7. Furthermore, the length n of slot 22 is determined by the longitudinal extent e of channel fingers 26 reduced by twice the sum of dimension j of spacer fingers 30 and recess dimension p. Thus, horizontal arm 14 is readily constructed by inserting a spacer 24 at either end of parallelly opposed channel members 20, applying pressure to the channel backs 28 to hold the channels 20 and spacers 24 together and welding the assembly together by spot or bead welding. Alternatively, spacers 24 may be inserted at either end of one of channel member 20 to firmly abut the inside of channel back 28, the spacers welded together, and then the second channel member 20 welded to spacers 24 to complete the assembly. End caps 25 are then inserted. Two end caps 25 are used in the preferred embodiment in order to provide a symmetrical structure to thus facilitate assembly. However, it will be understood that only one or no end caps may be used with corresponding changes in the dimensions shown.

In order to support horizontal arm 14 in a cantilever fashion on vertical post 16, a plurality of brackets 34, 36 are provided. Bracket 34 is fixed to the upper surface of horizontal arm 14 and bracket 36 is fixed to the lower surface of the arm as by welding. Brackets 34, 36 are provided with tongues 38 which mate with grooves 40 formed in vertical post 16. Brackets 34 and 36 are readily removable from engagement with vertical post 16 so that the display sign may be disassembled and made compact for ready transportation.

Referring now to FIGS. 3 and 4, two embodiments of display panels are illustrated for use in the present invention. Panel 12A as illustrated in FIG. 3 has a lower portion 42 and an upper portion 44. Lower portion 42 has a width less than that of upper portion 44, thus forming a shoulder 46 between the two portions. In the display sign according to the present invention in which panel 12A is used, lower portion 42 of the panel is inserted into slot 22 through the top of horizontal arm 14. Panel 12A is permitted to drop into slot 22 until shoulder 46 rests against the top of spacer 24 as illustrated in FIG. 5. Panel 12A is thus supported on horizontal arm 14 for display of the advertising message on the panel. A display sign using a panel of the type of panel 12A is also illustrated in FIG. 1. Upper portion 44 of panel 12A may form a rider for the panel, including such information as the name of a real estate agent, a "sold" sign, or a company logo. Additionally, the upper portion 44 and the lower portion 42 may be sculpted so as to form a fanciful design such as a shield or the outline of a company logo.

An alternate embodiment of panel 12B is illustrated in FIG. 4. Panel 12B has a lower portion 48, an upper portion 50 and a neck portion 52 disposed between upper portion 50 and lower portion 48. Upper portion 50 has a width which is less than lower portion 48. Neck portion 52 is provided with a pair of cutouts or slots 53. In order to support panel 12B on horizontal arm 14, plates 54 are provided on the arm. Plates 54 are pivotally mounted on the upper surface of horizontal arm 14 by means of pins 56 as illustrated in FIGS. 6 and 7. When it is desired to install panel 12B on horizontal arm 14, plates 54 are pivoted about pins 56 to a position unblocking recess 22 as illustrated by the position of the plate on the left hand side of FIG. 7.

Panel 12B is then slid into recess 22 of horizontal arm 14 by inserting upper portion 50 through the bottom of recess 22 until neck portion 52 lies in the same plane as the upper surface of arm 14. Plates 54 are then pivoted about pin 56 to engage cutouts 53 in neck portion 52 thereby blocking a portion of slot 22 and thus reducing the length of slot 22. The blocking position of plate 54 is illustrated by the plate on the right hand side of FIG. 7. In the preferred embodiment, plate 54 is a one-piece, round, plastic disk or metal. Also in the preferred embodiment pin 56 is made from a yielding plastic with a cone-shaped terminus 57 (FIG. 6) so as to be readily snapped into place or removed from horizontal arm 14 thus allowing plate 54 to be snapped into position when it is desired to install a panel of the type of panel 12B, and to be removed completely when it is desired to install a panel of the type of panel 12A. In an alternative, but less preferred arrangement, the plate 54 may be riveted to the horizontal arm.

Referring now to FIGS. 1, 8, 9 and 10, the means for supporting display sign 10 in the ground is illustrated. In particular, in FIG. 9, foot 18 is illustrated at one stage of its manufacture. Foot 18 is manufactured from a flat, die cut sheet which, for example, may be 16 gauge steel. A square opening 58 is provided on one side of foot 18 and in vertical alignment therewith is provided a pole mating extension 60. On the opposite side of the foot a downwardly extending pointed tooth 62 is provided. The flat sheet illustrated in FIG. 9 is bent at right angles along fold lines 64 and 66 to produce the channeled foot illustrated in FIGS. 1, 8, and 10.

The bottom end 68 of vertical pole 16 is sharpened and is inserted in square opening 58 as illustrated in FIG. 8. Vertical pole 16 is then fixed to foot 18 at pole mating extension 60 as by weldments 70 (only one shown), as illustrated in FIG. 10. To support display sign 10 in the ground, sharpened end 68 of pole 16 is first driven into the ground by the application of pressure (i.e., foot pressure) on the top of foot 18. Next, tooth 62 of foot 18 engages and is driven into the ground and stabilizes display sign 10 in a vertical position.

In one embodiment, channel members 20 may be fabricated from 16 gauge steel and may have the following dimensions:

e=27½"
f=7/16"
g=1"

Similarly, spacer 24 has the following dimensions:

i=1"
j=2"
k=1"
p=¼"

Thus, the length n of slot 22 is 23" and the width m of slot 22 is ⅛". Panel 12 in this embodiment has a thickness of 0.090 inches and may be made from a high impact styrene or high density polyethylene plastic. Vertical post 16 may be made of 16 gauge steel, painted white, and coated with a polyethylene powder coat.

It is understood that the dimensions and materials given herein are only for the purposes of illustration and may be varied as desired within the scope of the invention.

Referring now to FIGS. 11–15, there is illustrated a display sign constructed in accordance with an additional and preferred embodiment of the invention and which is designated generally by reference numeral 100. Display sign 100 comprises a panel 112, a horizontal arm 114, a vertical post 116, and a foot 118.

The panel is similar in construction to that shown in the embodiments of FIGS. 1–10, and is supported by horizontal arm 114. Horizontal arm 114 is supported in cantilever fashion on vertical post 116.

Figure 12:
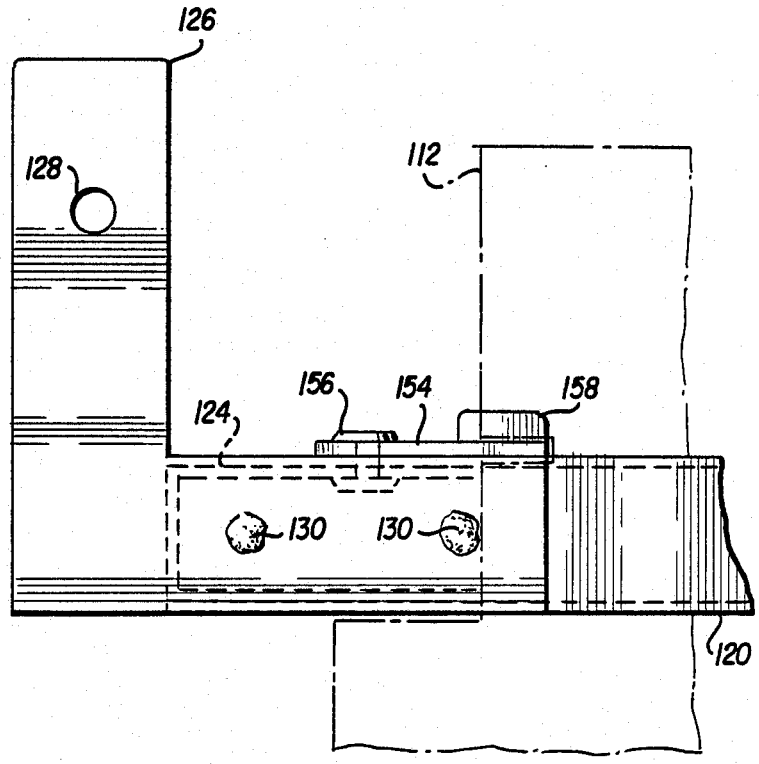
FIG. 12 is an enlarged side view of a portion of the embodiment of FIG. 11, illustrating the mounting of the horizontal arm in greater detail.
Figure 13:
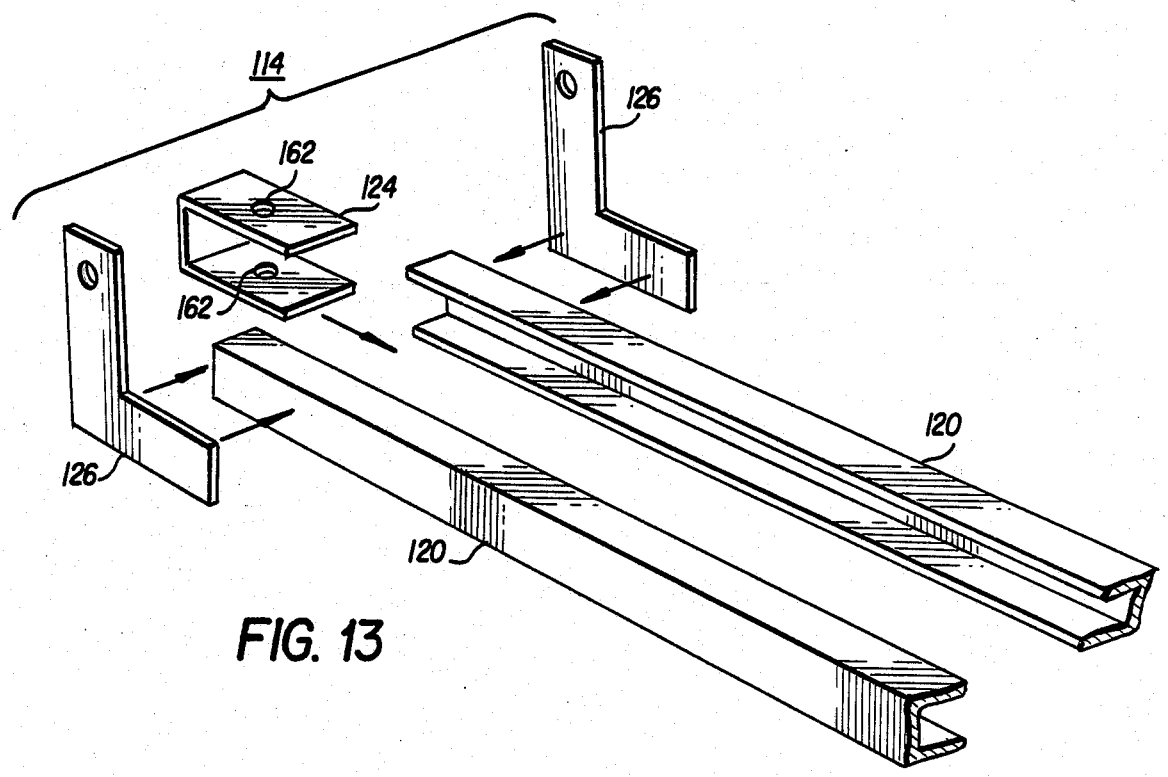
FIG. 13 is an exploded perspective view of the portion of the embodiment of FIG. 11 illustrated in FIG. 12.
Figure 14:
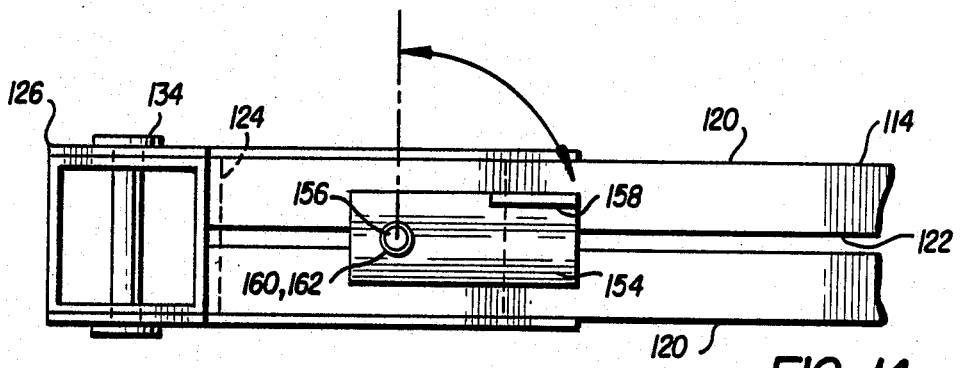
FIG. 14 is a plan view of the portion of the embodiment of FIG. 11 illustrated in FIG. 12.

Referring now to FIGS. 12 through 14, the construction of horizontal arm 114 and the support of horizontal arm 114 on vertical post 116 is shown in greater detail. Horizontal arm 114 is formed from a pair longitudinally extending U-shaped channel members 120. Channel members 120, together with a pair of spacers 124, are positioned similarly to the embodiment of FIGS. 1–10 to form a slot 122 in horizontal arm 114, and accordingly will not be described in greater detail. A pair of die cut angle bracket members 126 are spot welded as at weldments 130 to the outer faces of the channel members 120, at one end thereof. Each angle member 126 is provided with an aperture 128, mating with similar apertures 132 disposed on vertical post 116. The assembled horizontal arm 114, including angle members 126, channel members 120, and spacers 124, is pivotally mounted on vertical post 116 by means of a suitable fastener 134, which may be, for example, a rivet, pin or nut and bolt. Horizontal arm 114 is thus supported on vertical post 116 in a cantilevered fashion, with horizontal arm 114 being supported in the horizontal plane by the abutment of the ends of channel members 120 and spacer 124 against vertical post 116, as illustrated in the solid-line position of FIG. 11. When it is desired to store or transport the display sign 100, horizontal arm 114 may be pivoted about the axis formed by fastener 134, apertures 128, and apertures 132, into parallel, side-by-side relation with vertical post 116 as shown in the dashed-line position illustrated in FIG. 11. The display panel is preferably removed from slot 112 prior to pivoting horizontal arm 114 into its storage and transportation position, however, it may be left in horizontal arm 114, depending on the storage or transportation requirements.

Figure 15:
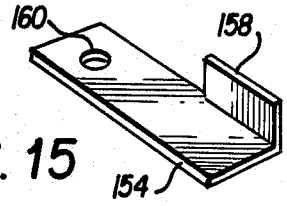
FIG. 15 is a perspective view of an alternative embodiment of a blocking device for blocking a display panel in the horizontal arm of the display sign in accordance with the present invention.

Referring now to FIG. 15, with further reference to FIGS. 12 and 14, a panel blocking plate 154 is illustrated. Plate 154 is provided with an aperture 160 and a thumb push tab 158 which vertically extends above the top surface of plate 154. Plate 154 is fixed to the upper surface of horizontal arm 114 by means of a pin or rivet 156 installed through aperture 160 in plate 154 and one of the apertures 162 in spacer 124. A similar plate 154 is connected to a spacer (not shown) at the opposite end of horizontal arm 114, in the same manner as described above and in connection with the embodiment of FIGS. 1 through 10. When it is desired to install a panel on horizontal arm 114, plates 154 are pivoted about pins 156 to a position unblocking recess 122. Plate 154 is rectangularly shaped and is made sufficiently large so that together with raised thumb push tab 158, plate 154 may be easily pivoted from its panel blocking to its panel unblocking position or vice versa.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A display sign comprising:

a panel adapted to receive a display, said panel comprising a lower portion, an upper portion having a predetermined width and a neck potion disposed between said upper and lower portion having a predetermined width less than that of the upper portion;

a vertical post;

a horizontal arm supported in cantilever fashion on said vertical post;

a through slot formed in said horizontal arm from top to bottom thereof; and means for supporting said panel in said slot whereby said panel is supported on said horizontal arm, said means for supporting said panel in said slot comprising means for selectively reducing the length of said slot from a first length greater than or equal to the width of the upper portion of said panel to a second length less than the width of said upper portion and greater than or equal to the width of the neck portion of said panel.

2. The display sign of claim 1 wherein said horizontal arm comprises a pair of channel members, disposed parallel with respect to one another and spaced apart from one another to form a gap therebetween, and including a pair of spacers, one of said spacers being positioned at one end of the parallelly disposed channel members, the other of said spacers being positioned at the opposite end of the plurality disposed channel members, said spacers spanning said channel members and joining said channel members together, whereby the slot in said horizontal arm is formed by the gap between said channel members.

3. The display sign of claim 2 wherein each of said channel members has a U-shaped cross-section and the channel members are disposed so that the open faces of the channel members are opposed to one another and each of said spacers having a U-shaped cross-section and being dimensioned so as to fit within the U-shaped cross-section of the channel members, said spacers being oriented within the channel members so as to block a portion of the slot in said horizontal arm whereby the length of said slot is reduced.

4. The display sign of claim 1 wherein said means for supporting the panel in the slot comprises a plate pivotally mounted on said horizontal arm for selective positioning between a position blocking a portion of the slot to support the panel on the arm and a position exposing the slot to remove the panel from the arm.

5. The display sign of claim 4 wherein the plate comprises a disc removably mounted on the top surface of the arm.

6. The display sign of claim 1 wherein the horizontal arm is removably supported on the vertical post by means of at least one bracket mounted on said horizontal arm, said bracket having a tongue mating with a groove formed in said vertical post.

7. The display sign of claim 6 further comprising a first bracket mounted on the upper surface of the horizontal arm said first bracket having a plurality of tongues extending away therefrom, a second bracket mounted on the lower surface of the horizontal arm, said second bracket having a plurality of tongues extending away therefrom, and a plurality of grooves formed in said vertical post mating with the tongues of said first and second brackets.

8. The display sign of claim 1 further comprising a foot fixed to the vertical post in the bottom area of the vertical post, said foot extending laterally away from said vertical post and having a tooth adapted to be driven into the ground, said vertical post being sharpened at its bottom end and extending through an aperture in said foot, whereby when said foot and vertical post are driven into the ground the panel is supported on said horizontal arm in an upright position.

9. A display sign comprising:

a panel adapted to receive a display;

a vertical post;

a horizontal arm supported in cantilever fashion on said vertical post;

a through slot formed in said horizontal arm; and means for supporting said panel in said slot whereby said panel is supported on said horizontal arm, said supporting means further comprising means pivotally mounting said horizontal arm on said vertical post whereby said horizontal arm is adapted to be moved between a horizontal position for display of said panel and a postion in which the horizontal arm is in substantially parallel, side-by-side relation with said vertical arm for storage and transportation of said sign.

10. The display sign of claim 9 wherein said panel comprises an upper portion having a predetermined width and a lower portion having a predetermined width less than that of the upper portion, said means for supporting said panel in said slot comprises means for reducing the length of said slot to a length less than the width of the upper portion of said panel and greater than or equal to the width of the lower portion of said panel.

11. The display sign of claim 9 wherein the means pivotally mounting the horizontal arm on the vertical post comprises a bracket member fixed to said horizontal post and pivotally connected to said vertical post.

12. The display sign of claim 11 wherein said bracket member is pivotally connected to said vertical post by means of mating apertures in said bracket member and said vertical post and a fastener extending through said mating apertures.

13. The display sign of claim 11 wherein said bracket member is fixed to said horizontal arm by welding.

14. The display sign of claim 12 wherein said bracket member is an angle member.

15. The display sign of claim 4 wherein the plate comprises a rectangular plate.

16. The display sign of claim 15 wherein said rectangular plate has a thumb push tab projecting upwardly from the surface of said rectangular plate.

17. A display sign comprising:

a panel adapted to receive a display and having a first panel portion and a second panel portion and notches disposed between the first and second panel portions;

a vertical post;

a horizontal arm having first and second ends, said arm being supported at said first end in cantilever fashion on said vertical post and having a top and a bottom, said second end being a free end;

a through slot formed in said horizontal arm extending through the top and bottom of said arm intermediate the first and second ends thereof, said slot defining an elongated rectangular opening between the ends of said arm through which said panel is adapted to extend in an operative position such that said first panel portion is disposed above the top of said arm and said second panel portion is disposed beneath the bottom of said arm; and means cooperating between said panel and said arm for releasably supporting said panel in said slot in said operative position, said means for supporting said panel comprising means movable relative to said slot for reducing the length of said slot and releasably engaging in the notches in said panel.

* * * * *

UNITED STATES PATENT AND TRADEMARK OFFICE

CERTIFICATE OF CORRECTION

PATENT NO. : 4,790,092

DATED : December 13, 1988

INVENTOR(S) : KENNETH R. FARMER

It is certified that error appears in the above-identified patent and that said Letters Patent is hereby corrected as shown below:

TITLE PAGE

Inventor's address should be --2397 Church Road
Smyrna, Georgia 30080--.

IN THE SPECIFICATION:

Column 1, line 43, "a" should be --an--.

Signed and Sealed this

Twenty-third Day of May, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,790,092

DATED : December 13, 1988

INVENTOR(S) : KENNETH R. FARMER

It is certified that error appears in the above-identified patent and that said Letters Patent is hereby corrected as shown below:

Claim 1 should read as follows:

1. A display sign comprising:

a panel adapted to receive a display, said panel comprising a lower portion, an upper portion having a predetermined width and a neck portion disposed between said upper and lower portion having a predetermined width less than that of the upper portion;

a vertical post;

a horizontal arm supported in cantilever fashion on said vertical post;

a through slot formed in said horizontal arm from top to bottom thereof; and means mounted on said horizontal arm for supporting said panel in said slot whereby said panel is supported on said horizontal arm, said means for supporting said panel in said slot comprising means for selectively reducing the length of said slot from a first length greater than or equal to the width of the upper portion of said panel to a second length less than the width of said upper portion and greater than or equal to the width of the neck portion of said panel wherein said supporting means cooperates with said neck portion to retain said panel on said horizontal arm.

UNITED STATES PATENT AND TRADEMARK OFFICE

CERTIFICATE OF CORRECTION

PATENT NO. : 4,790,092

DATED : December 13, 1988

INVENTOR(S) : KENNETH R. FARMER

It is certified that error appears in the above-identified patent and that said Letters Patent is hereby corrected as shown below:

Claim 2, column 7, line 57, "plurality" should be --parallelly--.

Claim 9 should read as follows:

9. The display sign of claim 1 further comprising means pivotally mounting said horizontal arm on said vertical post whereby said horizontal arm can be moved between a horizontal position for display of said panel and a position in which the horizontal arm is in substantially parallel, side-by-side relation with said vertical arm for storage and transportation of said sign.

Claim 17, column 9, line 13, delete "a" and insert --an upper--;
column 9, line 14, after "a" insert --lower--;
column 10, line 12, after "means" insert --attached to said horizontal arm--.